US009463966B1

(12) United States Patent
Damabi

(10) Patent No.: US 9,463,966 B1
(45) Date of Patent: Oct. 11, 2016

(54) SCISSOR LIFT HAVING SIDE RAMPS WITH CENTRAL LIFT PLATFORM

(71) Applicant: Mehdi Mirzaie Damabi, Brentwood, TN (US)

(72) Inventor: Mehdi Mirzaie Damabi, Brentwood, TN (US)

( * ) Notice: Subject to any disclaimer, the term of this patent is extended or adjusted under 35 U.S.C. 154(b) by 325 days.

(21) Appl. No.: 14/281,400

(22) Filed: May 19, 2014

Related U.S. Application Data

(60) Provisional application No. 61/824,803, filed on May 17, 2013.

(51) Int. Cl.
*B66F 3/22* (2006.01)
*B66F 7/06* (2006.01)
*B66F 7/24* (2006.01)

(52) U.S. Cl.
CPC ..... *B66F 3/22* (2013.01); *B66F 7/065* (2013.01); *B66F 7/243* (2013.01)

(58) Field of Classification Search
CPC ..... B66F 3/22; B66F 7/065; B66F 7/243
USPC ..... 254/122, 124, 126, 88
See application file for complete search history.

(56) References Cited

U.S. PATENT DOCUMENTS 1,869,420 A * 8/1932 Hard ..... B66F 7/243 254/124
2,576,544 A * 11/1951 Smith ..... B66F 7/243 104/44
3,835,957 A * 9/1974 Richards ..... B66F 7/065 182/141
3,865,214 A * 2/1975 Clark ..... B66F 7/08 254/2 B
4,212,374 A * 7/1980 Bubik ..... B66F 7/26 187/204
4,394,888 A * 7/1983 Clarke ..... B65G 69/2811 14/71.1
4,445,665 A * 5/1984 Cray ..... B66F 7/243 254/88
4,573,663 A * 3/1986 Nussbaum ..... B66F 7/065 254/122
4,724,930 A * 2/1988 VanLierop ..... B66F 7/065 187/204
4,901,980 A * 2/1990 Hansen ..... B25H 1/0007 254/124
5,215,287 A * 6/1993 Leski ..... B66F 3/22 254/122
5,503,368 A * 4/1996 Torres ..... B66F 7/0608 254/122
5,636,711 A * 6/1997 Nussbaum ..... B66F 7/0666 182/141
5,641,150 A * 6/1997 Rober ..... B66F 7/243 254/88
5,765,859 A * 6/1998 Nowell ..... B60G 7/00 280/43.17
5,855,359 A * 1/1999 Chipperfield ..... B66F 7/0608 254/122
6,269,676 B1 * 8/2001 Soyk ..... B66F 7/0641 72/457
2001/0035522 A1 * 11/2001 Brunnhoelzl ..... B66F 5/04 254/8 B
2005/0133309 A1 * 6/2005 Liebetreu ..... B66F 7/28 187/211
2008/0156589 A1 * 7/2008 Marchand ..... B66F 7/065 187/219
2009/0307853 A1 * 12/2009 Setzer, Jr. ..... B65G 69/30 14/72.5
2010/0243973 A1 * 9/2010 Deuring ..... B66F 3/22 254/122
2012/0048653 A1 * 3/2012 Matthews ..... B66F 7/08 187/211
2012/0298941 A1 * 11/2012 Finkbeiner ..... B66F 7/28 254/93 R
2013/0193392 A1 * 8/2013 McGinn ..... B66F 7/243 254/93 R

* cited by examiner

*Primary Examiner* — Joseph J Hail
*Assistant Examiner* — Arman Milanian
(74) *Attorney, Agent, or Firm* — Wayne Edward Ramage; Baker Donelson

(57) ABSTRACT

A movable scissor-lift device for lifting small wheeled vehicles, including, but not limited to, wheelchairs, mowers, ATVs, and the like. The scissor-lift provides a secure platform that can be raised to different heights. It can be easily moved and used to service, assemble, or build equipment in manufacturing plants, service centers, labs, hospitals, and the like. Various access openings on the lifting platform allow for easier servicing of equipment on the lift. Likewise, since the wheels of the vehicles hang free without being blocked by the body of the lift, it is easier to access and service the wheels.

13 Claims, 12 Drawing Sheets

INTERMEDIATE POSITION

SCISSOR LIFT HAVING SIDE RAMPS WITH CENTRAL LIFT PLATFORM

This application claims benefit of and priority to U.S. Provisional Application No. 61/824,803, filed May 17, 2013, by Mehdi Mirzaie Damabi, and is entitled to that filing date for priority. The specification, figures and complete disclosure of U.S. Provisional Application No. 61/824,803 are incorporated herein by specific reference for all purposes.

FIELD OF INVENTION

This invention relates to a device for lifting wheelchairs, mowers, ATVs and other small wheeled vehicles.

BACKGROUND

Scissor lifts are used in many industrial and commercial applications. When servicing wheeled vehicles, one limitation of such lifts is the height of the lift, which often requires the use of a separate ramp for loading and unloading. This greatly increases the space needed for use of the lift. Further, many lifts are fixed in place, or do not have center-located wheels, and thus cannot be easily moved to different locations.

Accordingly, what is needed is a scissor lift that is mobile with sufficiently stable operation and lifting height.

SUMMARY OF INVENTION

In various embodiments, the present invention comprises a scissor-lift device for lifting small wheeled vehicles, including, but not limited to, wheelchairs, mowers, ATVs, and the like. It provides a secure platform that can be raised to different heights. It can be used to service, assemble, or build equipment in manufacturing plants, service centers, labs, hospitals, and the like. Various access openings on the lifting platform allow for easier servicing of equipment on the lift. Likewise, since the wheels of the vehicles hang free without being blocked by the body of the lift, it is easier to access and service the wheels.

In one embodiment, the device comprises a sloped main body or chassis comprising a pair of side ramps on either side of a center lift or platform. The main body is sloped in the overall shape of a ramp with a low profile for easy transfer (loading and unloading) of the wheeled vehicle onto the lift. The side ramps may comprise a plurality of holes, ridges, or treads to help hold the wheels of the wheeled vehicle in place during transfer.

The lift may comprise a plurality of wheels on its underside or sides for easy movement of the lift. In one embodiment, a pair of caster (movable) or fixed wheels are centrally located (made possible by the ramp shape of the main body), a pair of caster wheels are located in the back (i.e., the high end of the ramp shape), and one or more caster wheels or fixed wheels are located in the front. This allows the lift to be an easily maneuverable platform that can be positioned and moved to different locations quickly. The lift is moved and secured in place (such as by locking the wheels or engaging one or more foot brakes). The lift may further comprise handles to assist in movement of the lift.

Once the wheelchair or small vehicle is in place on the lift (i.e., all wheels of the vehicle are on the lift), then the user engages the foot pedals to operate the lift. There may be foot pedals on both sides of the lift for easy operation from either side. Operating the "up" pedal causes the center lift section to level off to a midway position (i.e., the front or lower end raises to the same level as the back or upper end), engage the bottom of the wheelchair or other vehicle, and continue raising the wheelchair or other vehicle vertically to a variety of different positions (for servicing or assembly). Operating the "down" pedal causes the center lift section to lower to the height of the back or upper end, and then lower the front end until it fits within the side ramps.

Operational power is supplied by a battery (or batteries) or other electrical power source. In one embodiment, the battery is a 24-volt battery. The lift comprises programmable electronics for different functions, and provides options for amperage, voltage, and drive mode. It further comprises an actuator that raises and lowers the lift.

The scissor mechanism is uniquely multi-functional, as it lifts vertically as well as angling down to match the sloped chassis when the center lift section is lowered all the way to the ground. In one embodiment, this mechanism comprises a cam which is designed to raise or lower the front of the lift independently when the center lift section is being moved from a fully-lowered to a midway position, or vice-versa. The combination of the shape of the tracks and slots on the main scissor arms make this possible. When the lift is lowered, the cam is in a free position, which causes the scissor to collapse enough at the front in order to be lowered in a shape of a ramp. In one exemplary embodiment, the cam may be held in place by hardware or a bar when moving from the fully-lowered to a midway position.

DETAILED DESCRIPTION OF EXEMPLARY EMBODIMENTS

In various embodiments, the present invention comprises a scissor-lift device for lifting small wheeled vehicles, including, but not limited to, wheelchairs, mowers, ATVs, and the like. It provides a secure platform that can be raised to different heights. It can be used to service, assemble, or build equipment in manufacturing plants, service centers, labs, hospitals, and the like. Various access openings on the lifting platform allow for easier servicing of equipment on the lift. Likewise, since the wheels of the vehicles hang free without being blocked by the body of the lift, it is easier to access and service the wheels.

As seen in FIGS. 1-10, in one particular embodiment the device comprises a sloped main body or chassis 10 comprising a pair of side ramps 12 on either side of a center lift or platform 20. The main body is sloped in the overall shape of a ramp with a low profile for easy transfer (loading and unloading) of the wheeled vehicle onto the lift. The side ramps may comprise a plurality of holes, ridges, or treads 14 to help hold the wheels of the wheeled vehicle in place during transfer.

Figure 10:
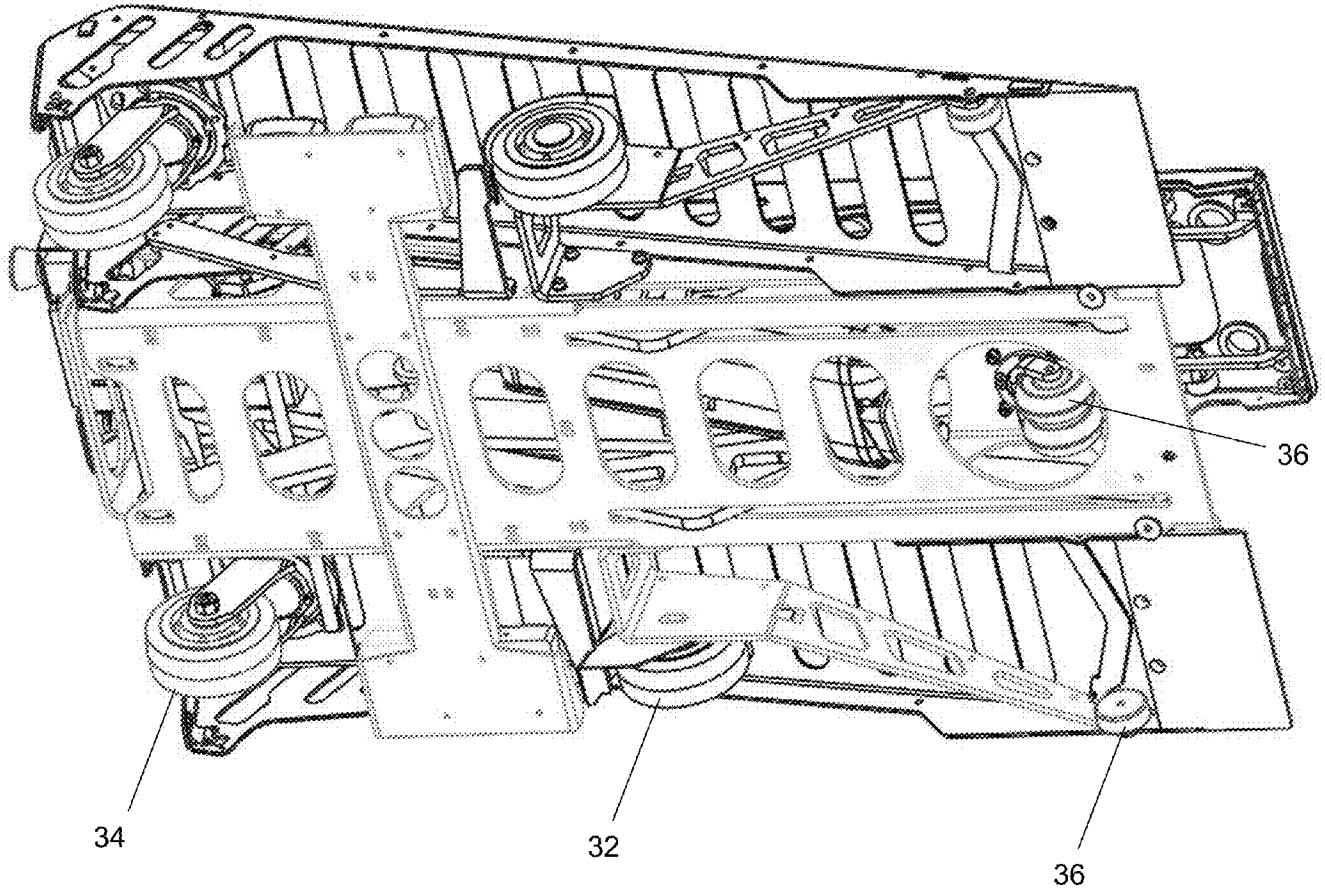
FIG. 10 shows a bottom view of the lift.
Figure 11:
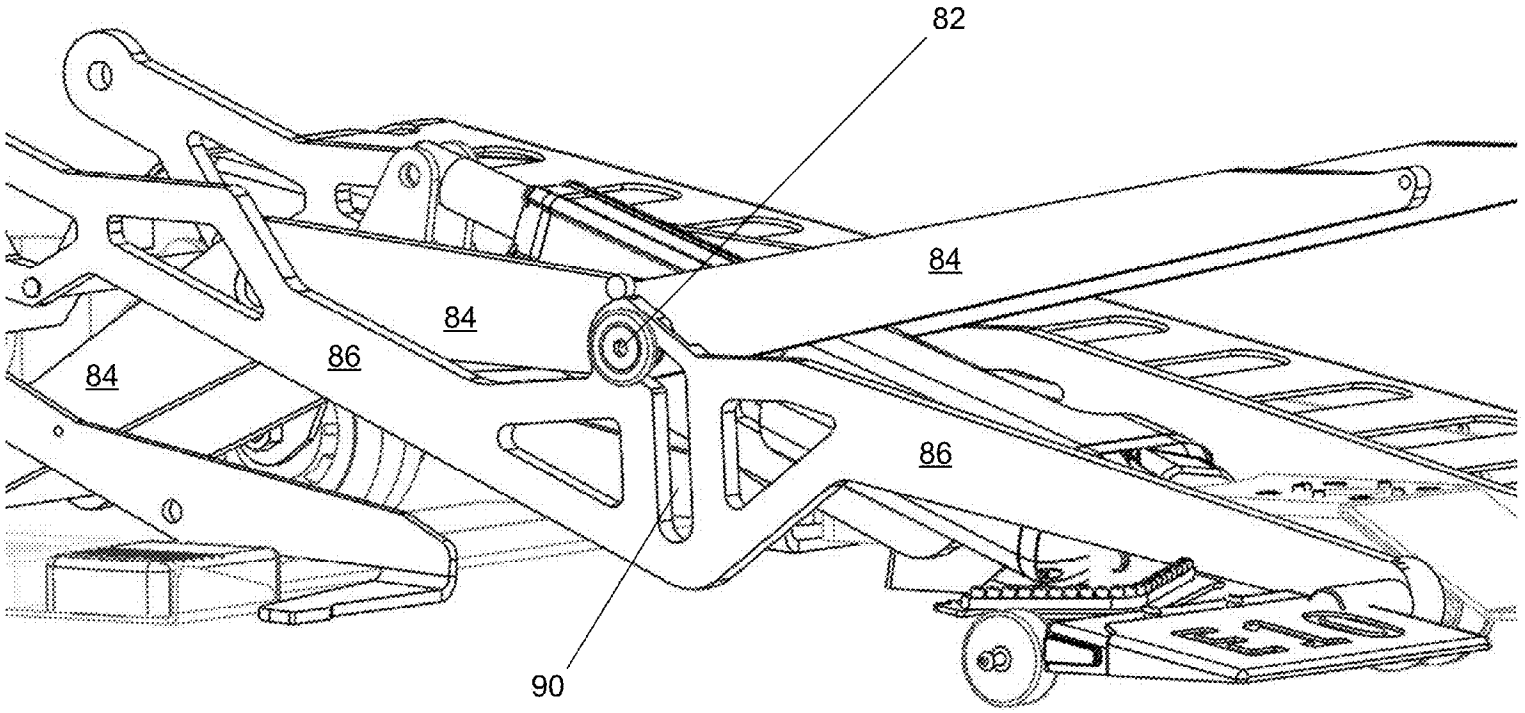
FIG. 11 shows a view of the cam mechanism when the lift is in a fully lowered position.
Figure 12:
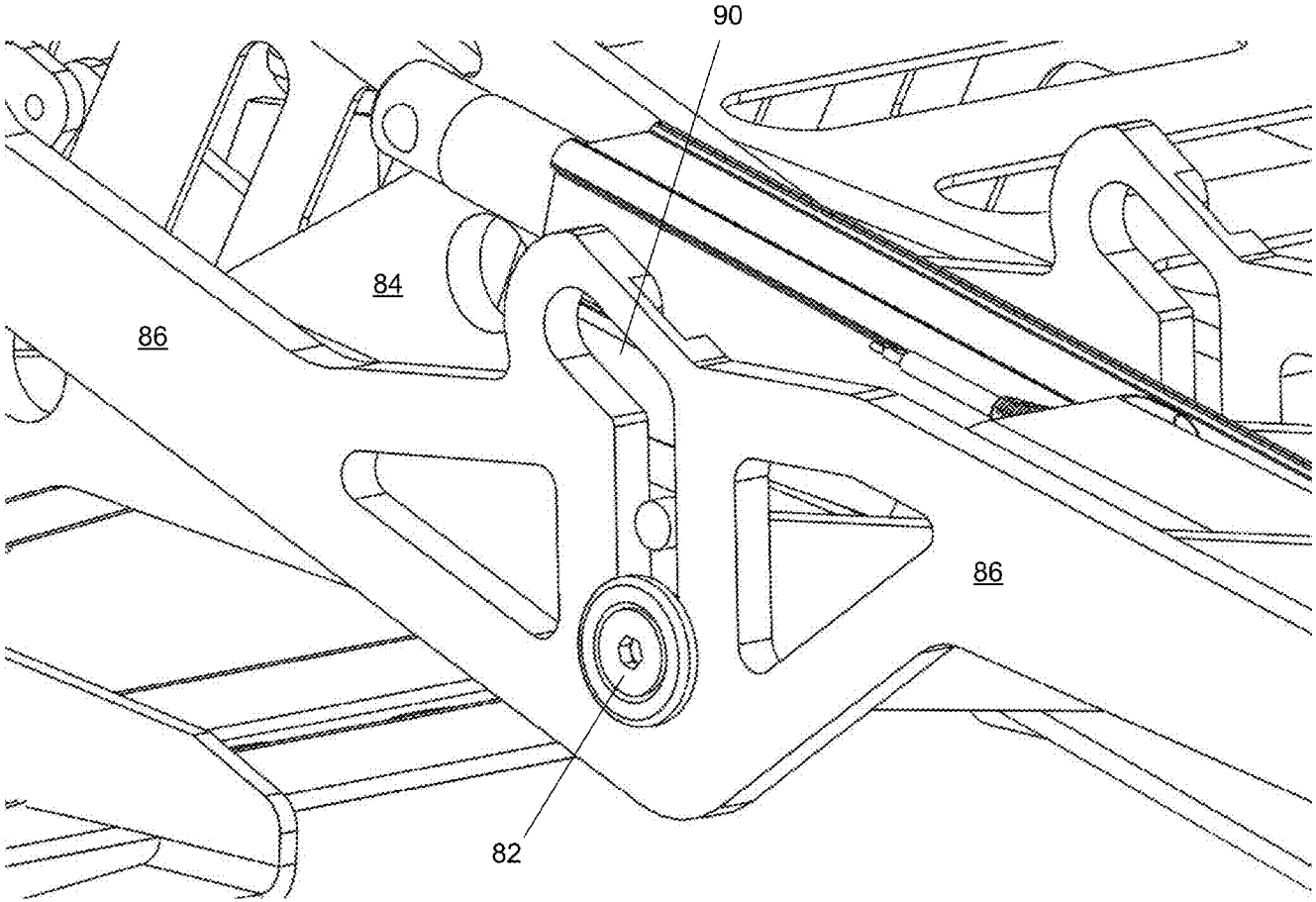
FIG. 12 shows a view of the cam mechanism when the lift is in a midway position.

As seen in FIG. 10, the lift comprises a plurality of wheels on its underside or sides for easy movement of the lift. In the embodiment shown, a pair of caster (movable) or fixed wheels 32 are centrally located (made possible by the ramp shape of the main body), a pair of caster wheels are located in the back 34 (i.e., the high end of the ramp shape), and one or more caster wheels or fixed wheels 36 are located in the front. This allows the lift to be an easily maneuverable platform that can be positioned and moved to different locations quickly. The lift is moved and secured in place (such as by locking the wheels or engaging one or more foot brakes 40). The lift may further comprise handles 50 to assist in movement of the lift.

Figure 1:
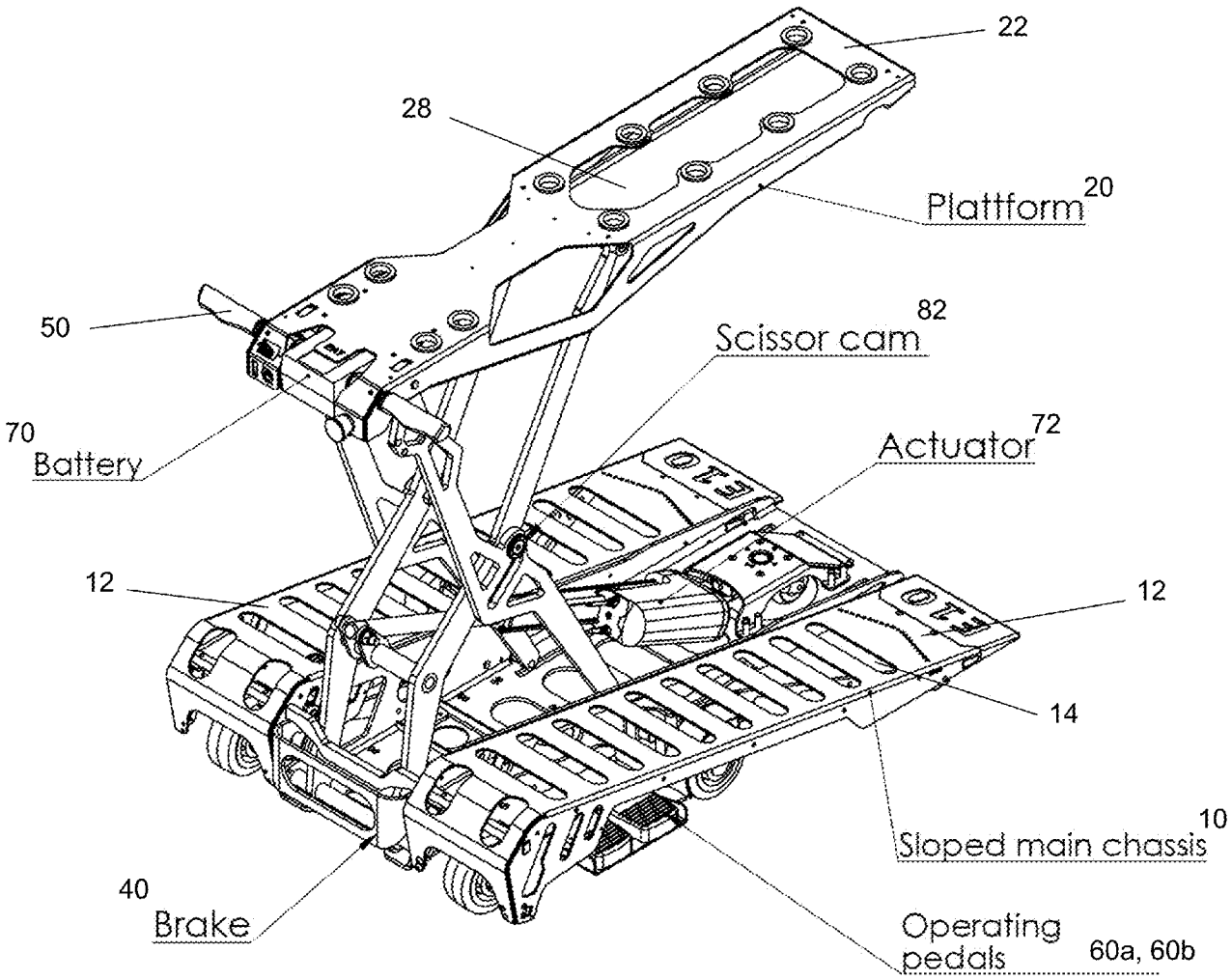
FIGS. 1-3 show perspective views of the lift in a fully lowered position.
Figure 2:
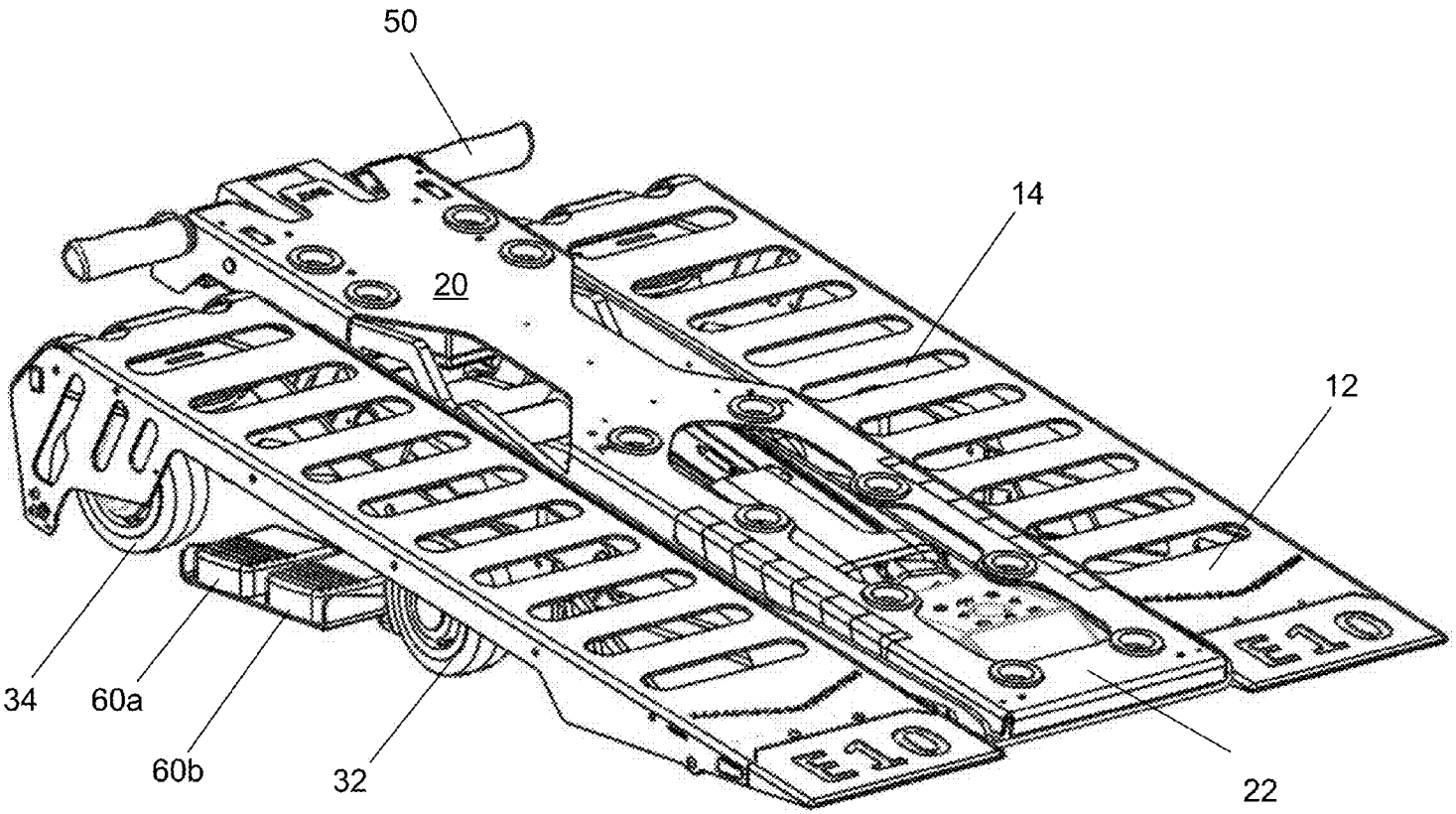
Figure 3:
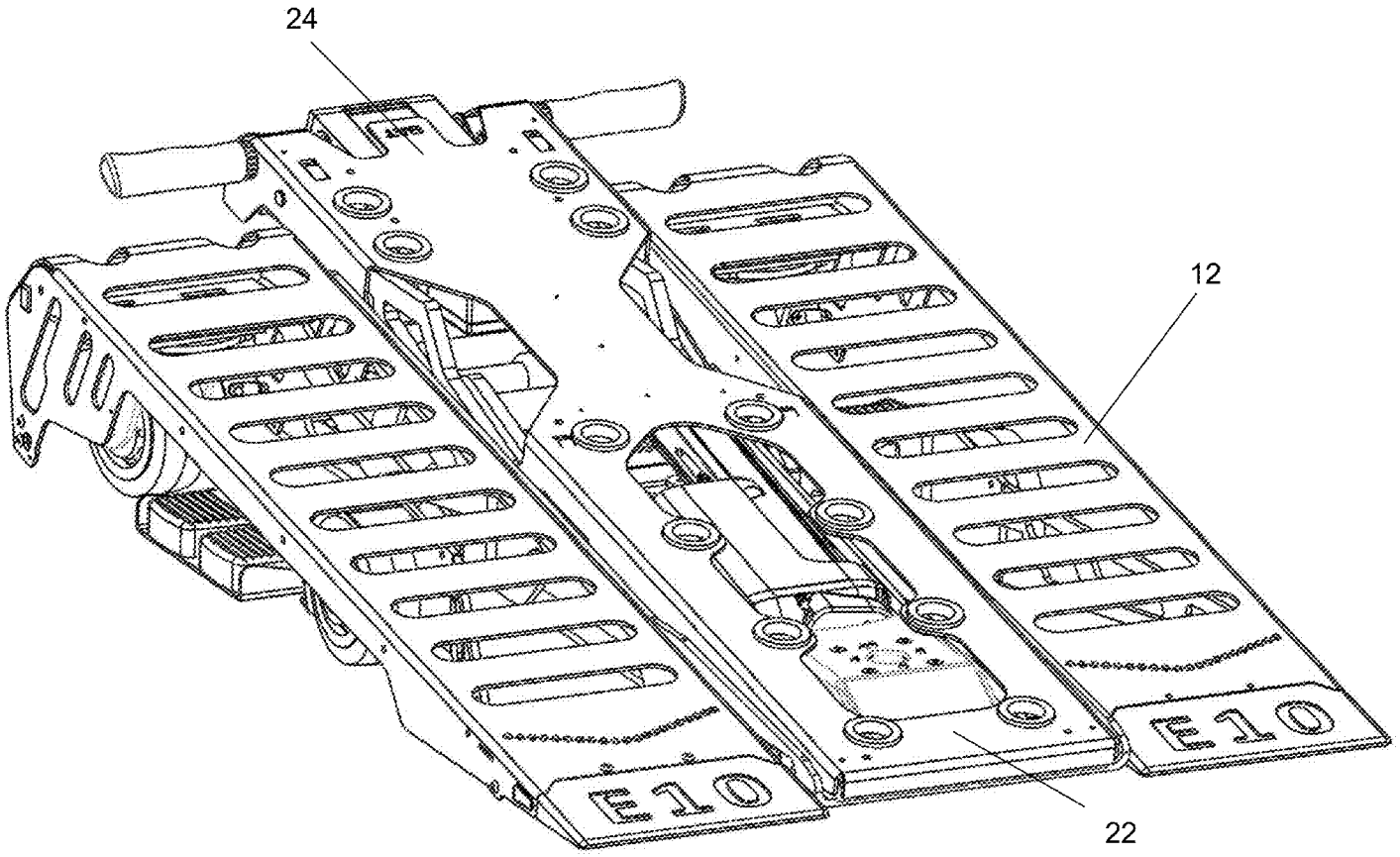
Figure 4:
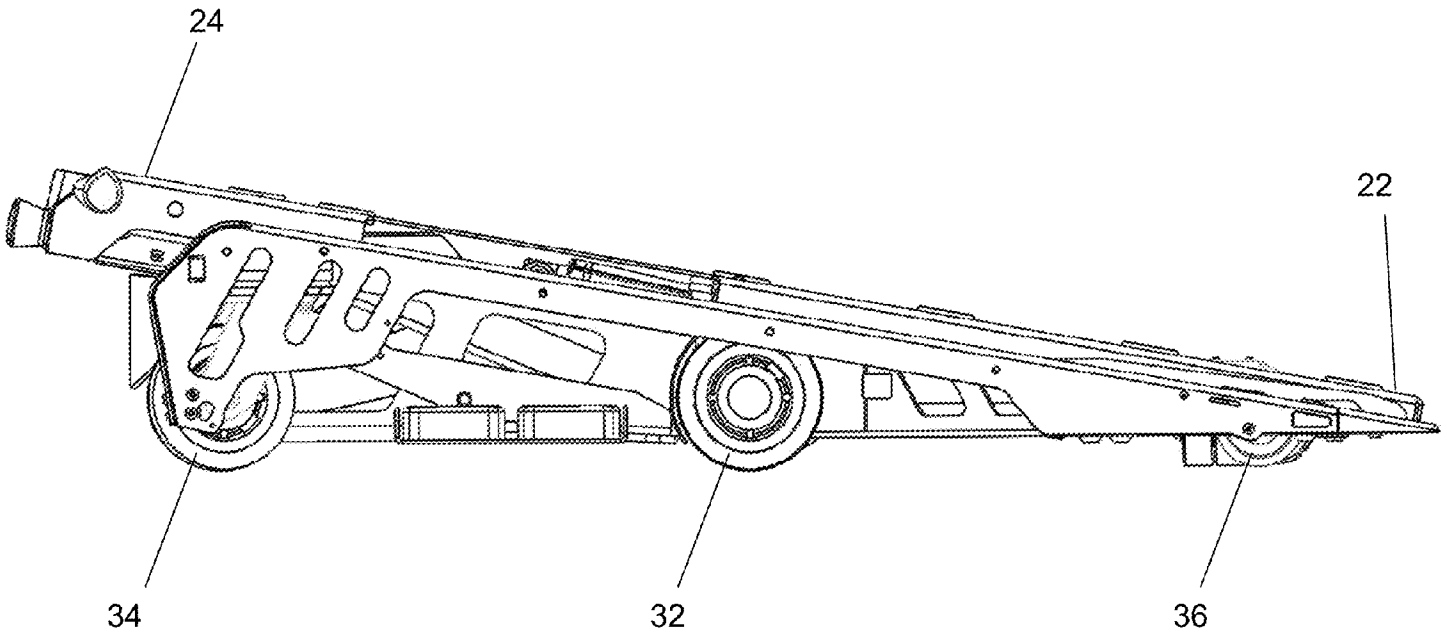
FIG. 4 shows a side view of the lift of FIG. 1.
Figure 5:
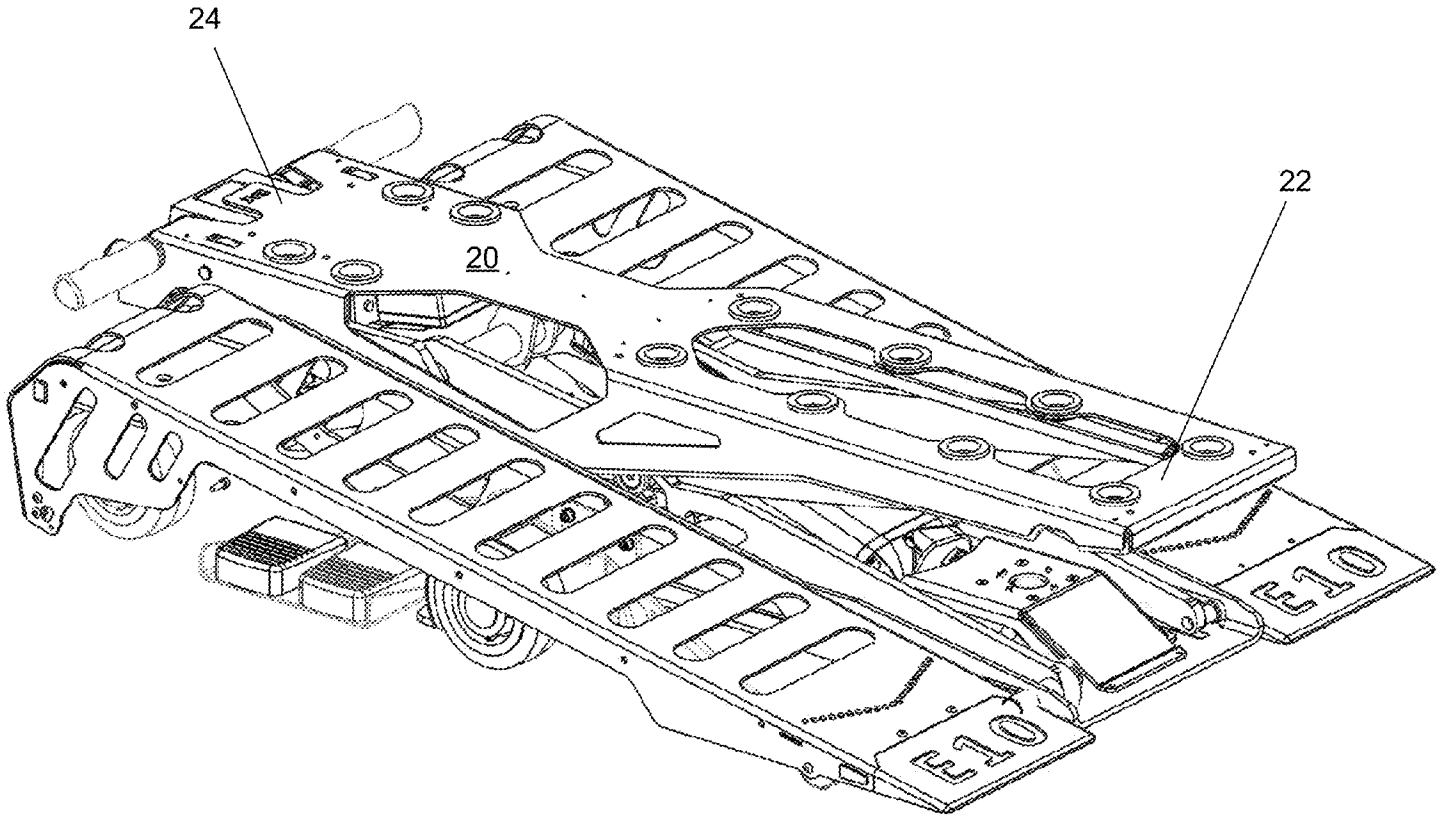
FIG. 5 shows a perspective view of the lift in a midway position.
Figure 6:
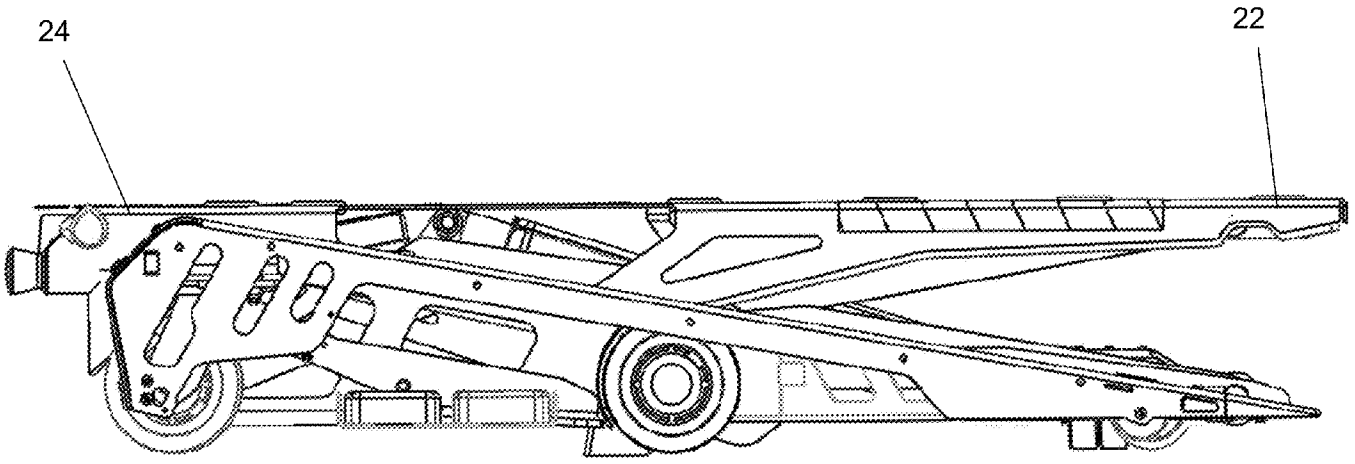
FIG. 6 shows a side view of the lift of FIG. 5.
Figure 7:
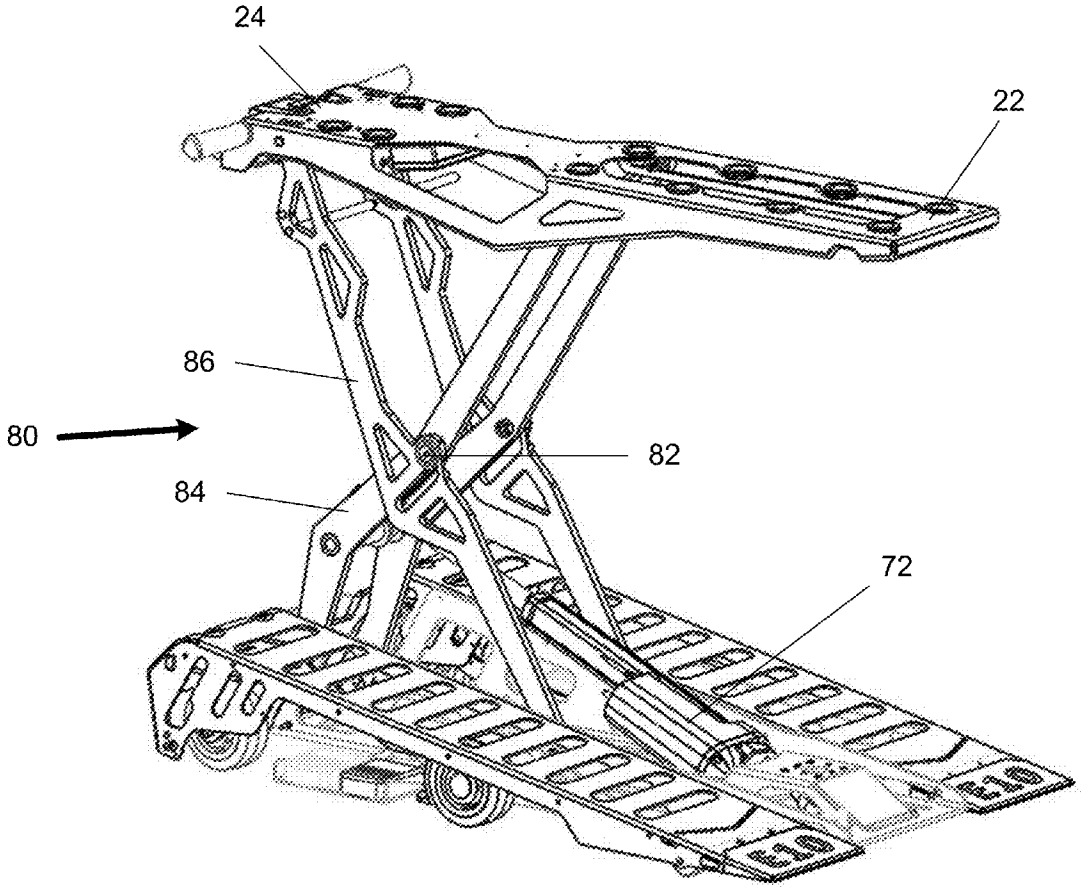
FIGS. 7-8 show perspective views of the lift in a fully raised position.
Figure 8:
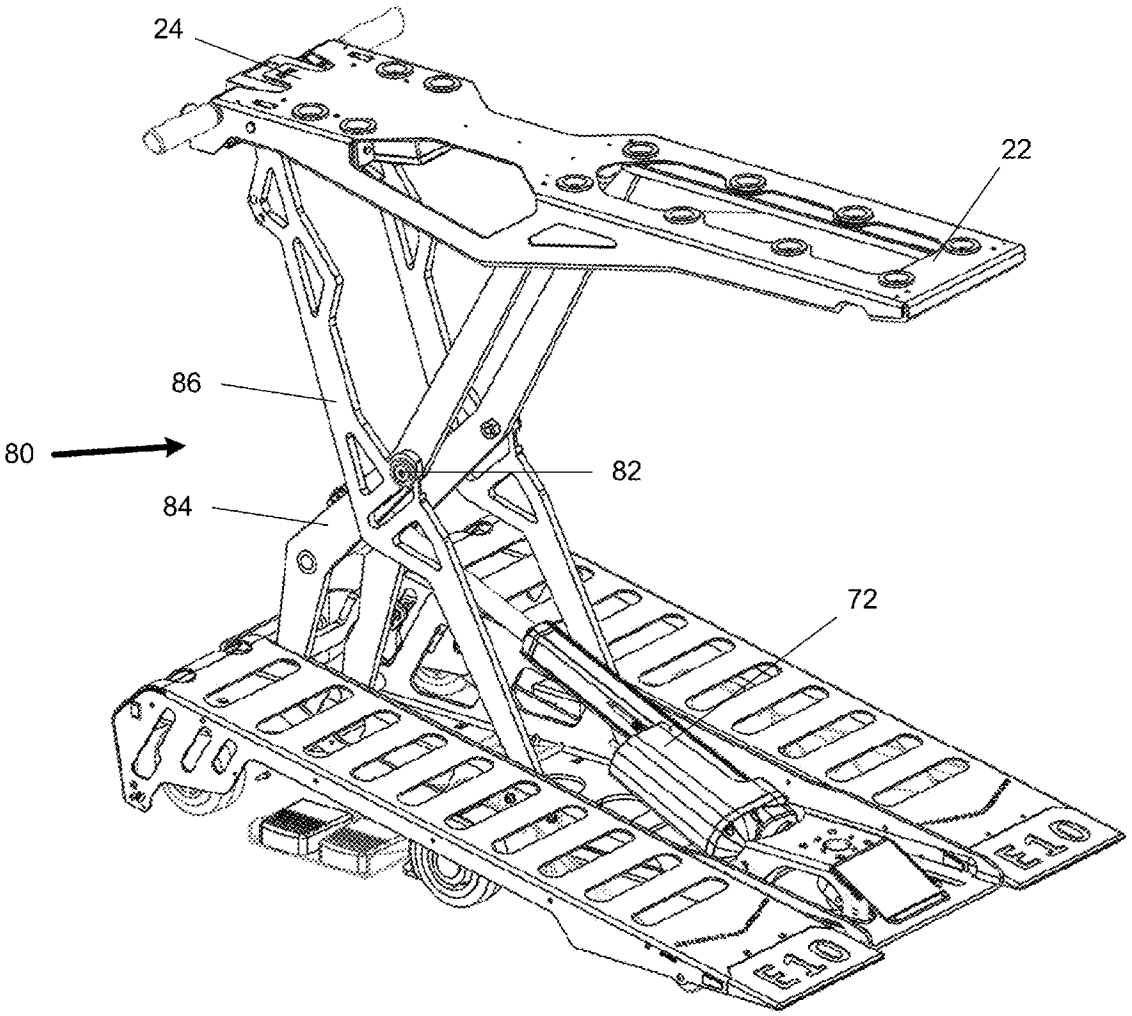
Figure 9:
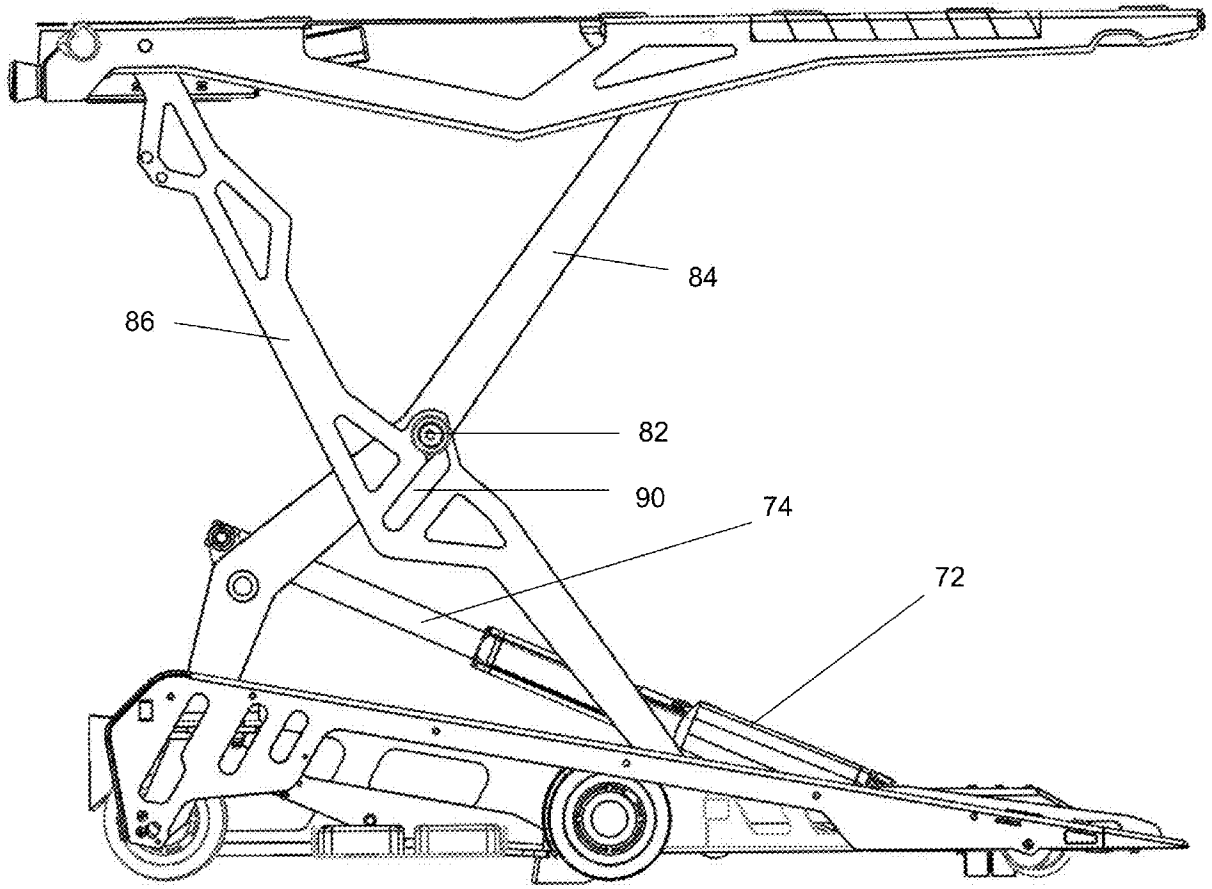
FIG. 9 shows a side view of the lift of FIG. 7.

Once the wheelchair or small vehicle is in place on the lift (i.e., all wheels of the wheelchair or vehicle are on the lift), then the user engages the foot pedals 60*a*, 60*b* to operate the lift. There may be foot pedals on both sides of the lift for easy operation from either side. Operating the "up" pedal 60*a* causes the center lift section 20 to level off to a midway position (i.e., the front or lower end 22 raises to the same level as the back or upper end 24), as seen in FIG. 5-6, engage the bottom of the wheelchair or other vehicle, and continue raising the wheelchair or other vehicle vertically (as seen in FIGS. 7-9) to a variety of different positions (for servicing or assembly). Servicing or assembly may be assisted through one or more holes or openings 28 in the center lift section or platform. Further, servicing or assembly is easier when the wheels of the vehicle are freely suspended at a convenient height. Operating the "down" pedal 60*b* causes the center lift section to lower to the height of the back or upper end, and then lower the front end until it fits within the side ramps (as seen in FIGS. 1-4).

Operational power is supplied by a battery 70 (or batteries) or other electrical power source. In one embodiment, the battery is a 24-volt battery. The lift comprises programmable electronics for different functions, and provides options for amperage, voltage, and drive mode. It further comprises an actuator 72 that raises and lowers the lift, typically through an actuator arm or rod 74 attached to the scissor mechanism 80.

The scissor mechanism 80 is uniquely multi-functional, as it lifts vertically as well as angling down to match the sloped chassis when the center lift section is lowered all the way to the ground. In one embodiment, this mechanism comprises a cam 82 as shown in FIGS. 6 and 7, which is designed to raise or lower the front of the lift independently when the center lift section is being moved from a fully-lowered to a midway position, or vice-versa. The combination of the shape of the tracks and slots 90 on the main scissor arms 84, 86 make this possible. When the lift is lowered, the cam is in a free position, which causes the scissor to collapse enough at the front in order to be lowered in a shape of a ramp. In one exemplary embodiment, the cam may be held in place by hardware or a bar 94 when moving from the fully-lowered to a midway position.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A scissor-lift, comprising:

a chassis comprising right and left side ramps on either side of a center lift platform with a front end and back end;

wherein the center lift platform can be raised and lowered independently of the side ramps;

further wherein the front end of the center lift platform is lower than the back end when the scissor-lift is in a fully-lowered position; and further wherein the front end of the center lift platform is at the same height of the back end when the scissor-lift is in a fully-raised position.

2. The scissor-lift of claim 1, further comprising:

a scissor mechanism attached to the chassis, adapted to raise and lower the center lift platform.

3. The scissor-lift of claim 2, further comprising:

an actuator mechanically connected to the scissor mechanism; and a power supply.

4. The scissor-lift of claim 2, further comprising:

one or more operating pedals to operate the scissor mechanism;

a plurality of wheels attached to the chassis;

and a locking mechanism or brake adapted to prevent the chassis from moving when engaged.

5. The scissor-lift of claim 1, wherein the side ramps are not raised or lowered.

6. The scissor-lift of claim 1, wherein the center lift platform has substantially the same slope as the side ramps when in a fully-lowered position.

7. The scissor-lift of claim 1, wherein the side ramps are adapted to allow a wheeled vehicle to be moved onto the ramps and loaded on the scissor-lift when the center lift platform is in a fully-lowered position.

8. The scissor-lift of claim 7, wherein the center lift platform does not engage said vehicle when said platform is in a fully-lowered position.

9. The scissor-lift of claim 1, wherein the front end of the center lift platform can be raised and lowered independently of the back end.

10. The scissor-lift of claim 1, wherein the front end of the center lift platform can be raised from a fully-lowered position to an intermediate position where the front end is at the same height of the back end, without the back end height changing from the fully-lowered position to the intermediate position.

11. The scissor-lift of claim 10, wherein the front end and back end are raised simultaneously from the intermediate position to a fully-raised position.

12. The scissor-lift of claim 1, wherein the center lift platform comprises one or more holes adapted to allow access to an item resting on the center lift platform.

13. The scissor-lift of claim 2, wherein said scissor mechanism comprises a right and left pair of scissor arms, each pair of scissor arms connected by a cam adapted to move along a track in one of said arms.

* * * * *